US006409894B1

(12) United States Patent
Boucard

(10) Patent No.: US 6,409,894 B1
(45) Date of Patent: Jun. 25, 2002

(54) LAY-OUT OF INSTALLATIONS IN AN ELECTROLYSIS PLANT FOR THE PRODUCTION OF ALUMINUM

(75) Inventor: Jean-Pierre Boucard, Biviers (FR)

(73) Assignee: Aluminium Pechiney, Paris Cedex 16 (FR)

( * ) Notice: Subject to any disclaimer, the term of this patent is extended or adjusted under 35 U.S.C. 154(b) by 0 days.

(21) Appl. No.: 09/556,773

(22) Filed: Apr. 25, 2000

(30) Foreign Application Priority Data

Mar. 24, 2000 (FR) ..... 00 03813

(51) Int. Cl.[7] ..... C25C 3/00

(52) U.S. Cl. ..... 204/244; 204/245

(58) Field of Search ..... 204/245, 244

(56) References Cited

U.S. PATENT DOCUMENTS

| | | | | |
|---|---|---|---|---|
| 4,474,611 | A | 10/1984 | Blanc et al. | 204/243 M |
| 4,592,821 | A | 6/1986 | Keinborg et al. | 204/244 |
| 4,683,047 | A | 7/1987 | Bolvin et al. | 204/243 M |
| 5,882,499 | A | 3/1999 | Bonnardel et al. | 205/396 |

OTHER PUBLICATIONS

Plant Design and Economics for Chemical Engineers, McGraw–Hill, 3rd ed., 1980, Chapter 1, pp. 1–11.*
La Technique Moderne, vol. 64, No. 12, 1972, pp. 65–67, XP002155185 (with English Abstract).

* cited by examiner

*Primary Examiner*—Donald R. Valentine
*Assistant Examiner*—Thomas H. Parsons
(74) *Attorney, Agent, or Firm*—Heller Ehrman White and McAuliffe LLP

(57) ABSTRACT

The object of the invention is an arrangement of an electrolysis plant for the production of aluminium using the Hall-Heroult process, with which it is possible to limit the pathway length of heavy flows, such as flows of liquid aluminium. According to the invention, the plant comprises:

at least one liquid aluminium production zone (H) comprising electrolysis pots arranged in lines, specific operational support zones, including a zone (C) grouping together the supply and recycling installations for anode assemblies, a zone (B) grouping together the supply and recycling installations for electrolysis baths, and a zone (A) grouping together the liquid aluminium processing installations, transport means to convey so-called heavy intermediate products (such as liquid aluminium) between said operational zones, at least one transit zone (101, 102, 103, 104, 105, 106, 110, 111, 112, 113) reserved for all or part of said transport means for the heavy intermediate products.

22 Claims, 10 Drawing Sheets

LAY-OUT OF INSTALLATIONS IN AN ELECTROLYSIS PLANT FOR THE PRODUCTION OF ALUMINUM

BACKGROUND OF THE INVENTION

1. Field of the Invention

The invention relates to aluminum production plants using the Hall-Héroult electrolysis smelting process. It particularly relates to the lay-out of installations for such plants.

2. Prior art

Metal aluminum is produced at the industrial level by igneous electrolysis, that is to say by the electrolysis of alumina in solution in a bath of smelted cryolite, called an electrolytic bath, using the well-known Hall-Héroult process. The electrolytic bath is contained in pots comprising a steel shell lined on the inside with refractory and/or insulating material, and a cathode assembly positioned at the bottom of the pot. Anodes in carbon material are partly immersed in the electrolytic bath. Each pot and its anodes form what is often called an electrolytic cell. The electrolysis current, which circulates in the electrolytic bath and the liquid aluminum layer via the anodes and cathode parts, conducts alumina reduction reactions and also enables the electrolytic bath to be maintained at a temperature in the region of 950° C. through the Joule effect.

Most modern plants have a large number of electrolytic cells arranged in lines, in buildings called electrolysis halls, which are electrically connected in series by means of link conductors so as to optimize the use of floor space in plants. The pots are generally arranged so as to form two or more parallel lines which are electrically connected to each other by end conductors. The electrolysis current therefore passes cascade fashion from one cell to the next. The length and mass of the conductors are as small as possible in order to limit investment and operating costs, in particular by reduction of losses through the Joule effect in the conductors. The conductors are also configured such as to reduce or offset, in whole or in part, the effects of magnetic fields produced by the electrolysis current.

When in operation, an electrolysis plant comprises a series of flows, in particular flows of raw materials (alumina, carbon powder, pitch), flows of intermediate products (solidified bath crusts, anode assemblies . . . ), flows of end products (liquid and/or solid aluminum), flows of personnel (persons on foot or drivers of automotive equipment), flows of energy (in particular flows of electric energy), flows of demolition products (in particular from anode baking furnaces), flows of tooling, flows of pot components (such as cathodes or pot shells) and flows of maintenance equipment. Some flows are essentially continuous (such as flows of raw materials), others are semi-continuous (such as flows of liquid aluminum, anode assemblies and solidified bath) and others are essentially discontinuous (such as flows of cathodes or pot shells).

These different flows are generated by the electrolysis process. For example, the Hall-Héroult process causes consumption of carbon anodes during electrochemical reactions of alumina reduction; this consumption requires the regular supply of new anodes and the replacement of spent anodes from the electrolysis cells, which generate flows of new anode assemblies from the anode production sites towards the electrolysis pots, and flows of spent anode assemblies from the pots towards the reprocessing and recycling sites.

For reasons relating to plant productivity, it is sought firstly to reduce investment and operating costs, and secondly simultaneously to obtain Faraday intensities and yields that are as high as possible while maintaining, even improving, the operating conditions of the electrolytic cells and giving consideration to a series of restrictions of a technical nature.

In particular, some flows generated by the operation of electrolysis plants may be conveyed by specific conveyance means, which is often the case for alumina flows and flows of emitted gases which are conveyed by specific channels which generally form fixed networks. However, several flows of materials follow pathways in common with other flows and/or with personnel access routes which is the case for so-called "heavy" flows of liquid metal, carbon products (such as anode assemblies) and solid bath (crusts, removed excess bath and recycled bath). Typically, these heavy flows which are in general essentially discontinuous, are conveyed by means of motorized equipment using transport routes (outside or inside the buildings) which run alongside the electrolysis pots, which routes are also used by personnel. The cohabitation of considerable movements of materials, equipment and personnel in the same working space also imposes a limit on the search for improving working and safety conditions. These problems are heightened by the fact that several flows require handling precautions and/or special environmental precautions.

In addition, the impact of problems related to flow density within a given plant and to physical interactions between flows and installations becomes rapidly greater if it is sought to increase the productivity of a plant. For example, the increase in electrolytic cell production, through an increase in current intensity, leads to a swift increase in the density of flows, in the intensity of magnetic interactions and in the unit loads to be transported.

The applicant therefore set out to find plant arrangements which take into account these different constraints, which lead to a reduction in investment and maintenance costs, and with which it is possible to increase plant production capacity.

BRIEF SUMMARY OF THE INVENTION

The subject of the invention is a layout for an electrolysis plant for the production of aluminum using the Hall-Héroult process, said plant comprising at least one liquid aluminum production zone H, characterized in that it comprises:

- specific operational support zones such as a zone C which groups together the supply and recycling installations for the anode assemblies, a zone B which groups together the supply and recycling installations for the electrolytic baths and a zone A grouping together the liquid aluminum processing installations,
- transport means for the conveyance, between said operational zones and according to determined intermediate flows, of said heavy products such as liquid aluminum, anode assemblies and solid electrolytic bath,
- at least one transit zone reserved for all or part of said transport means for heavy intermediate products.

In the search for a solution to the problems raised by known electrolysis plants, the applicant had the idea, firstly of grouping together certain installations of some heavy flows and, secondly, of using a reserved transit zone which would reduce distances travelled while avoiding the cohabitation of flows having low compatibility such as heavy flows, and flows of personnel. With the arrangement of the invention it is therefore possible both to optimise the distances travelled by the main heavy flows of an electrolysis plant, which carry a potential risk, and to take into account the effects of physical interactions between flows and installations.

The presence of a reserved transit zone also allows for greater control over operator working conditions and safety, in particular by restricting movements of personnel in this zone. It also provides for greater control over co-ordination of the process, over operational management and over environmental conditions required for certain heavy flows, such as the flow of spent anode assemblies removed from the electrolysis pots, which may require aspiration and effluent treatment means.

DETAILED DESCRIPTION OF THE INVENTION

Figure 1:
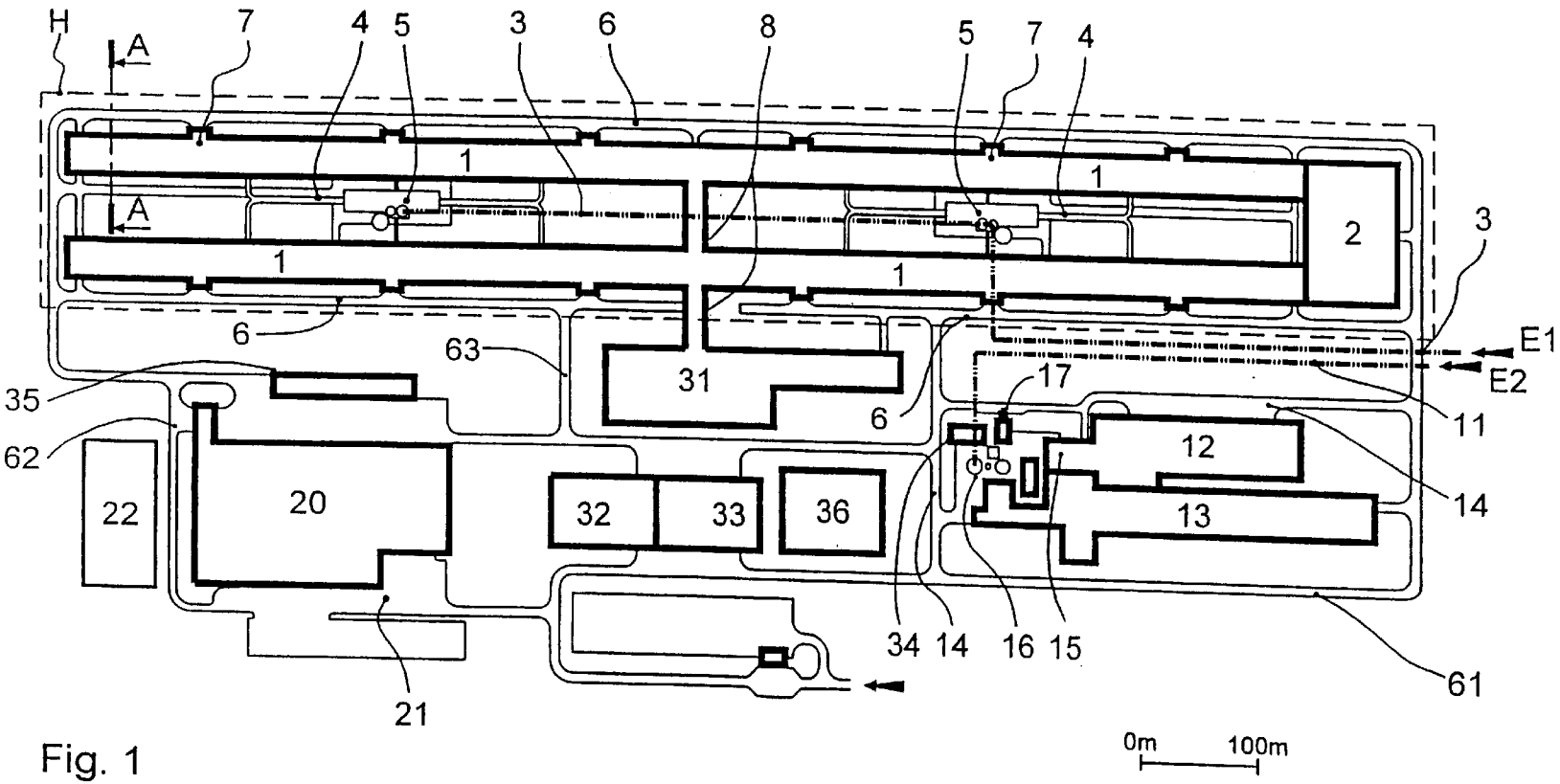
Fig. 1 PRIOR ART
FIGS. 1, 2, 3, 6*a*, 7*a*, 8*a*, 9*a* and 10*a* relate to the prior art.
Figure 2:
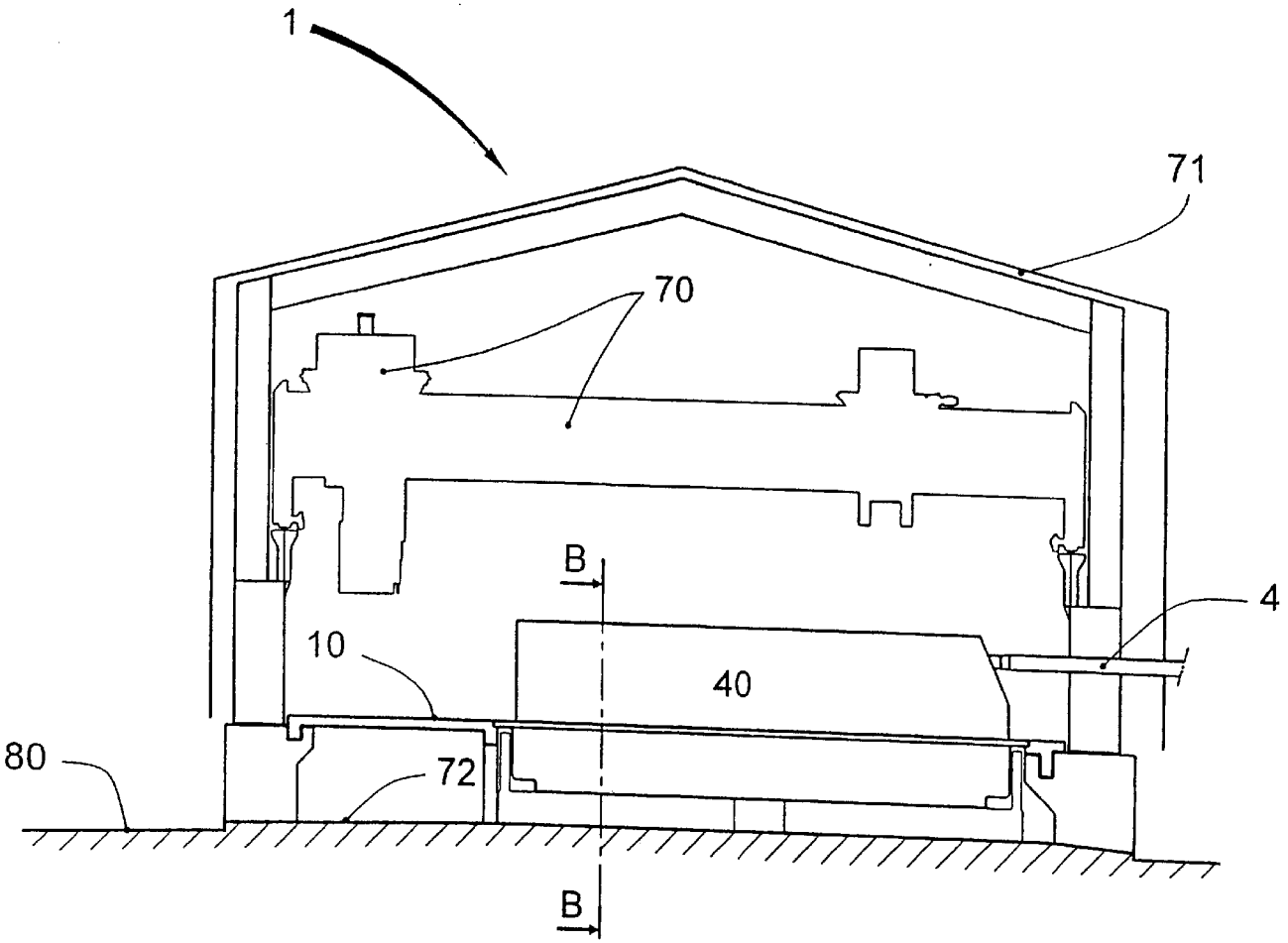
Fig. 2 PRIOR ART
Figure 3:
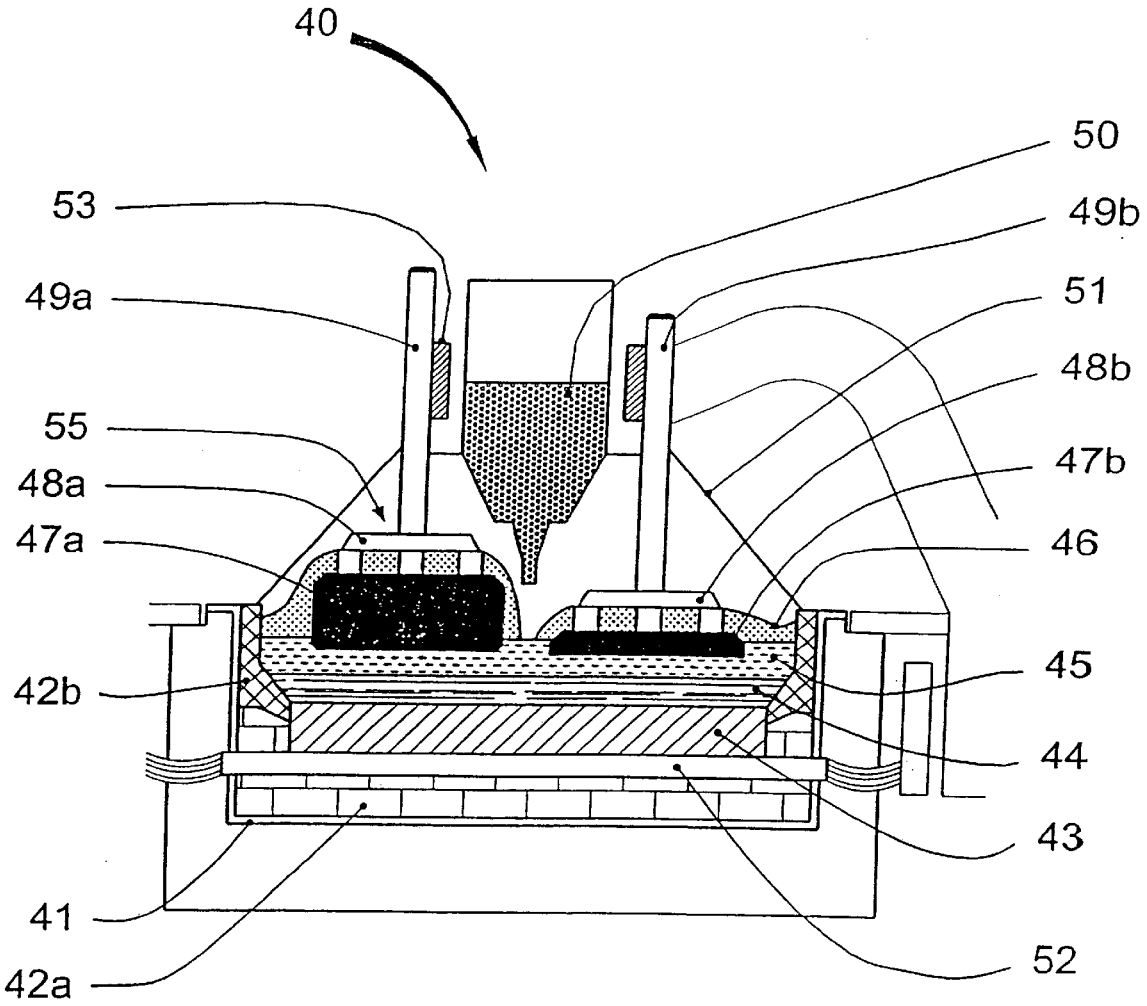
Fig. 3 PRIOR ART
Figure 4:
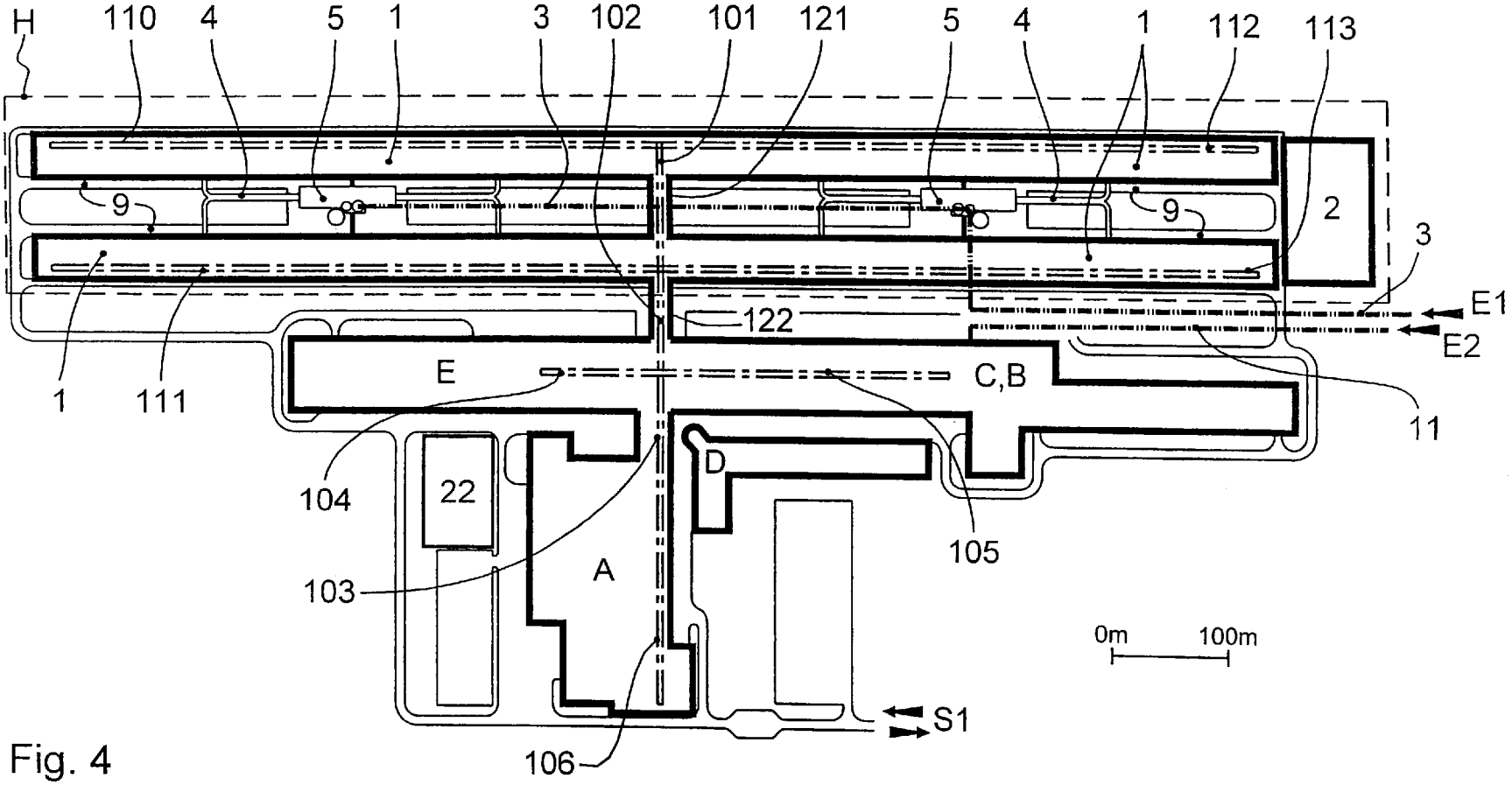
FIGS. 4, 5, 6*b*, 7*b*, 8*b*, 9*b* and 10*b* relate to the invention.
Figure 5:
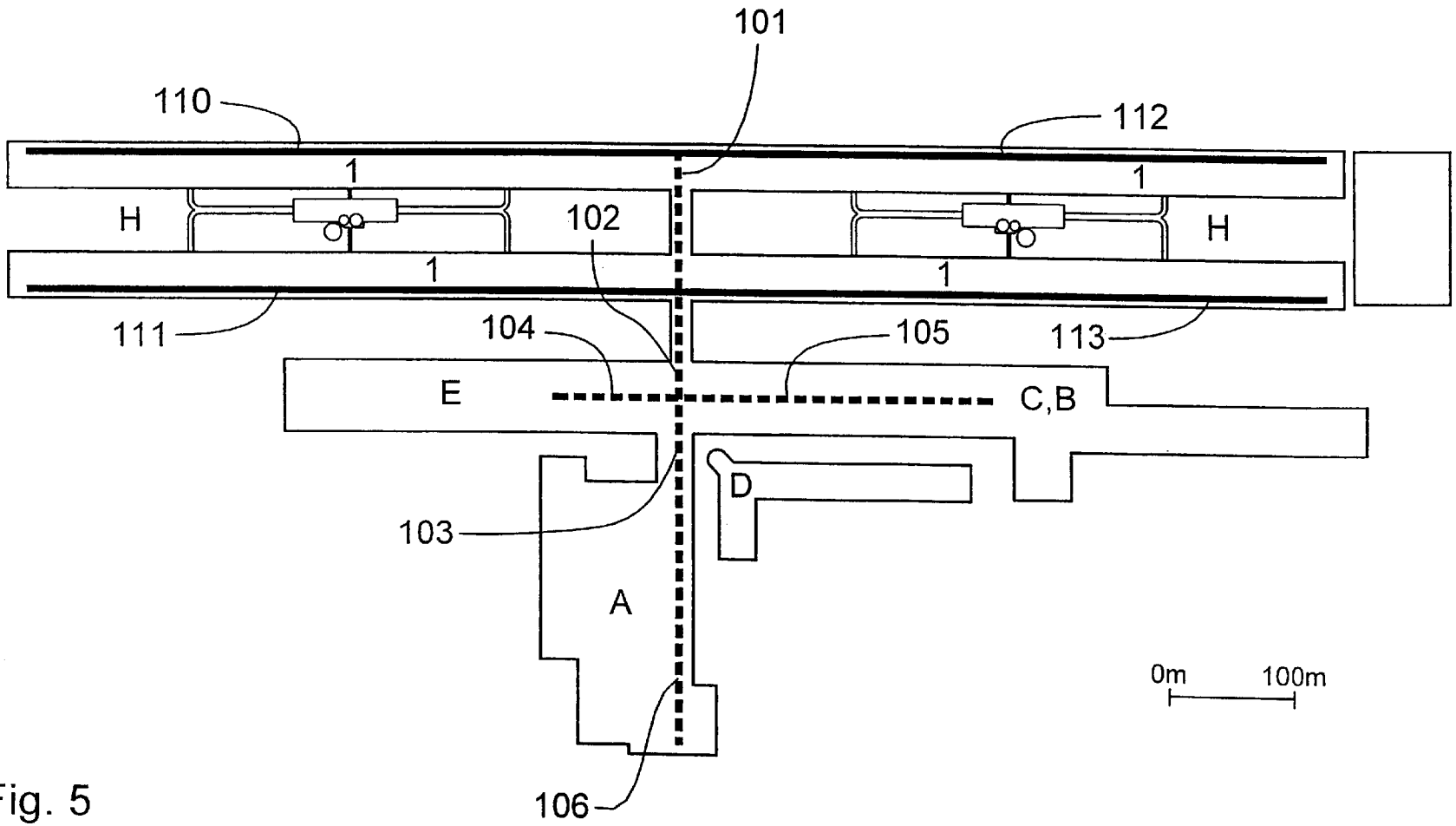
Figure 6:
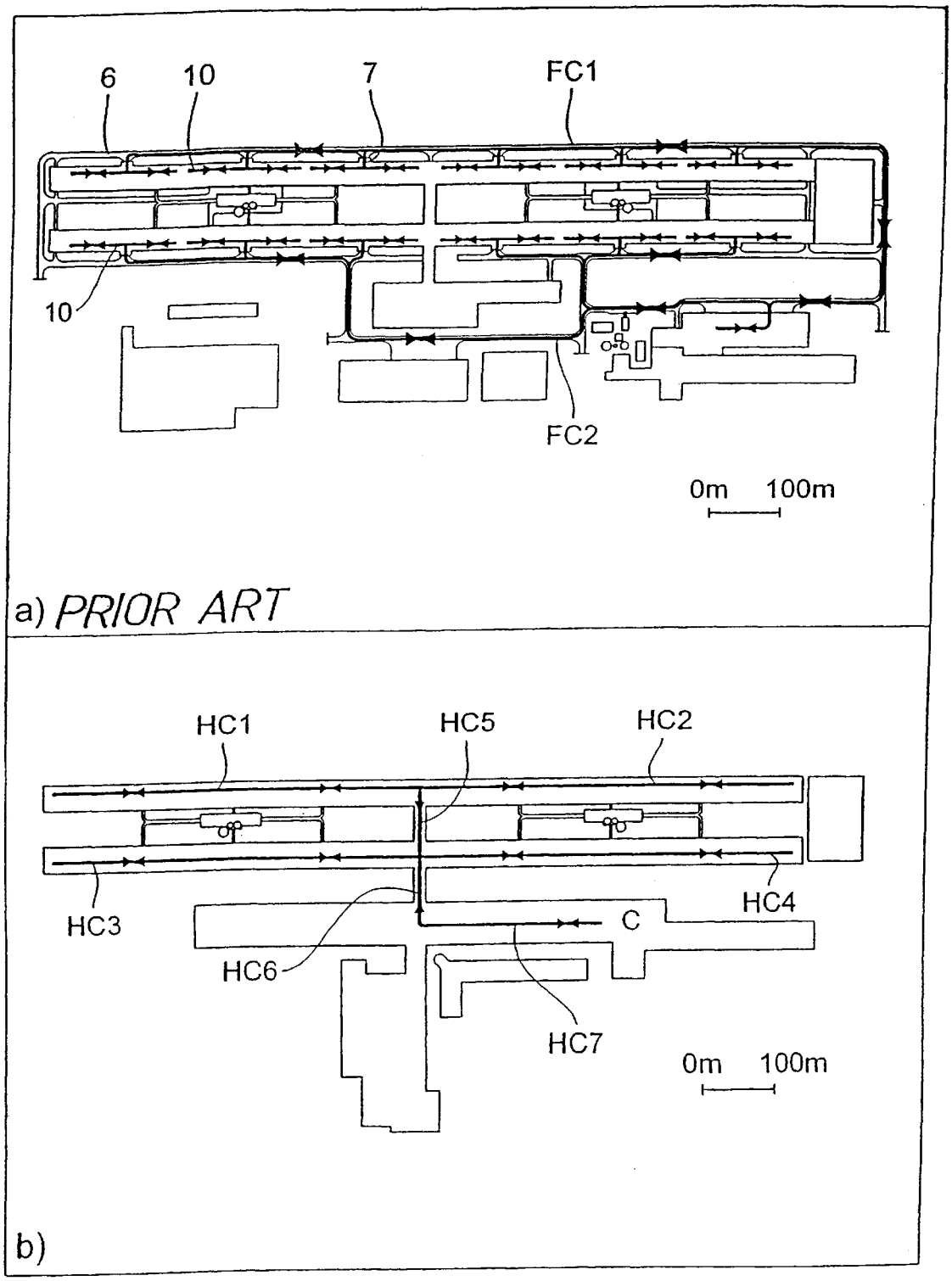
Figure 7:
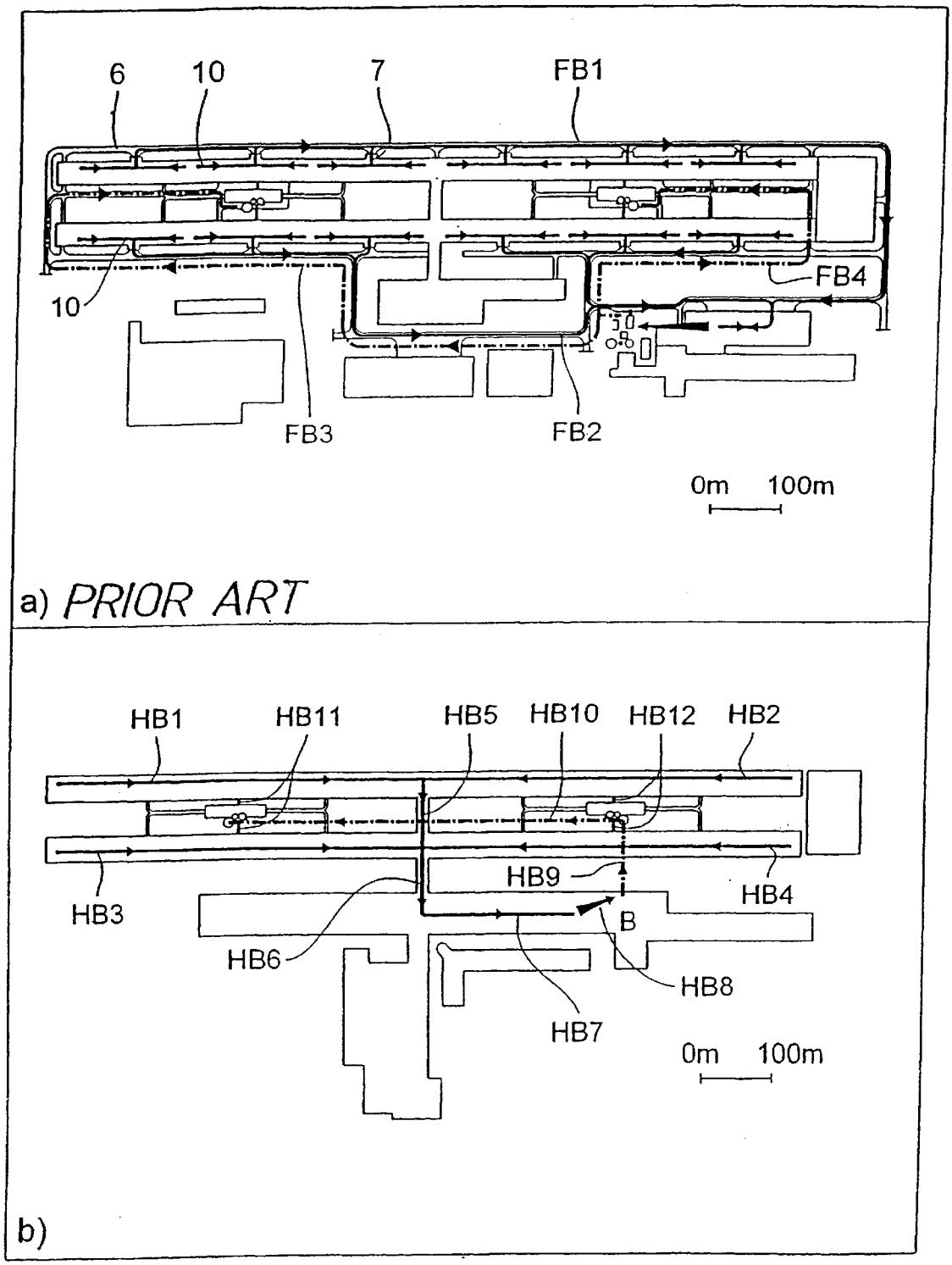
Figure 8:
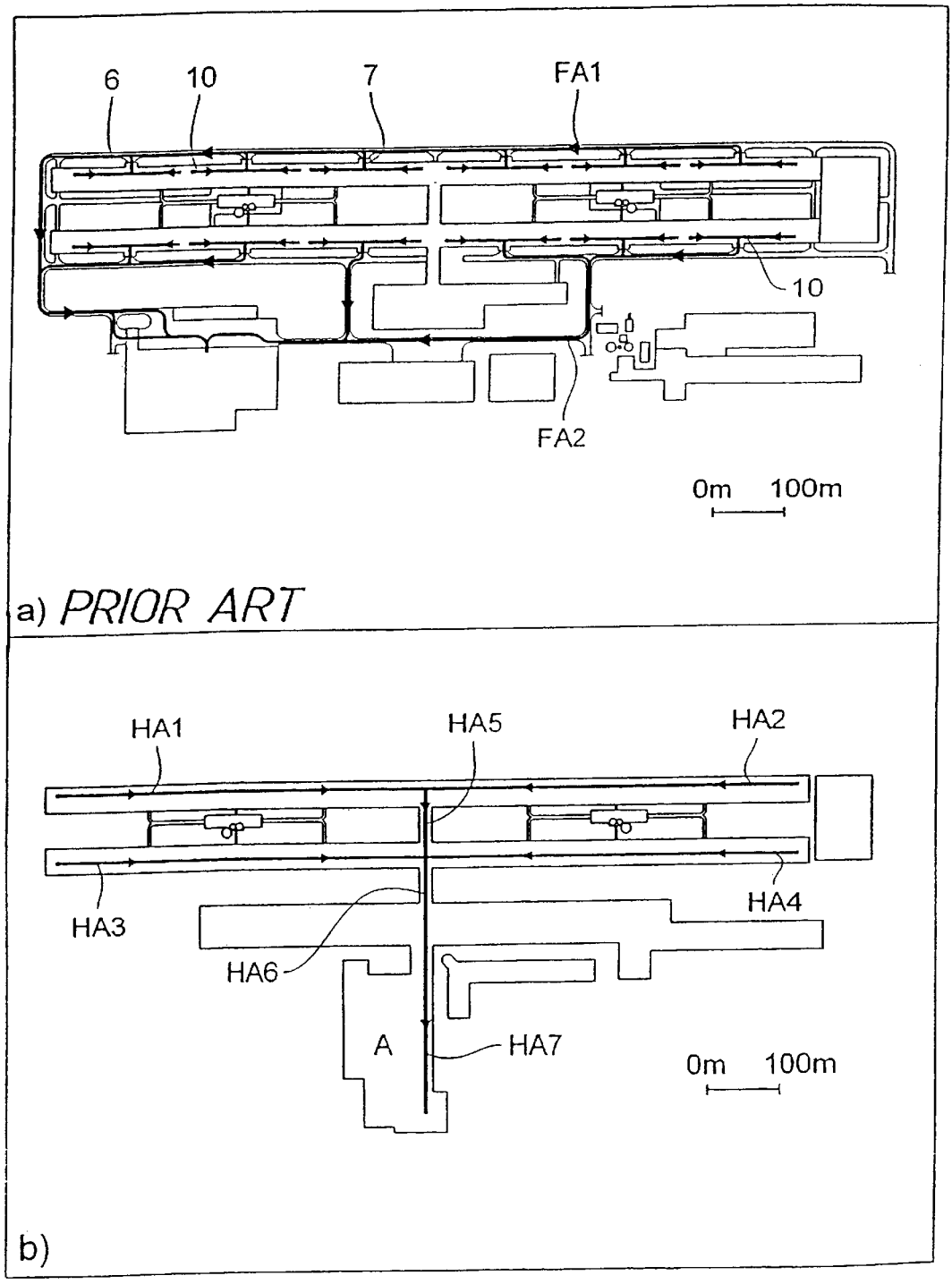
Figure 9:
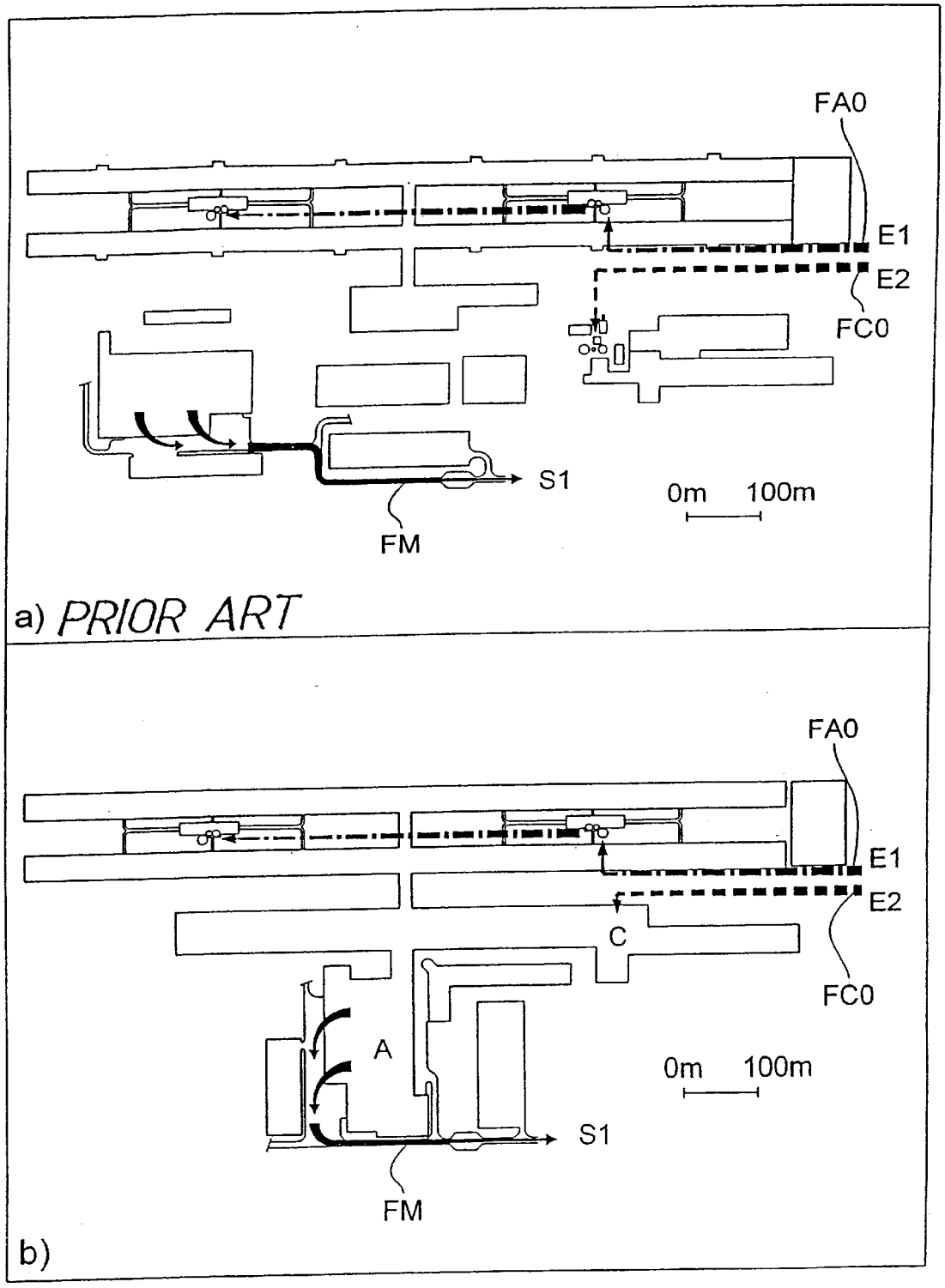
Figure 10:
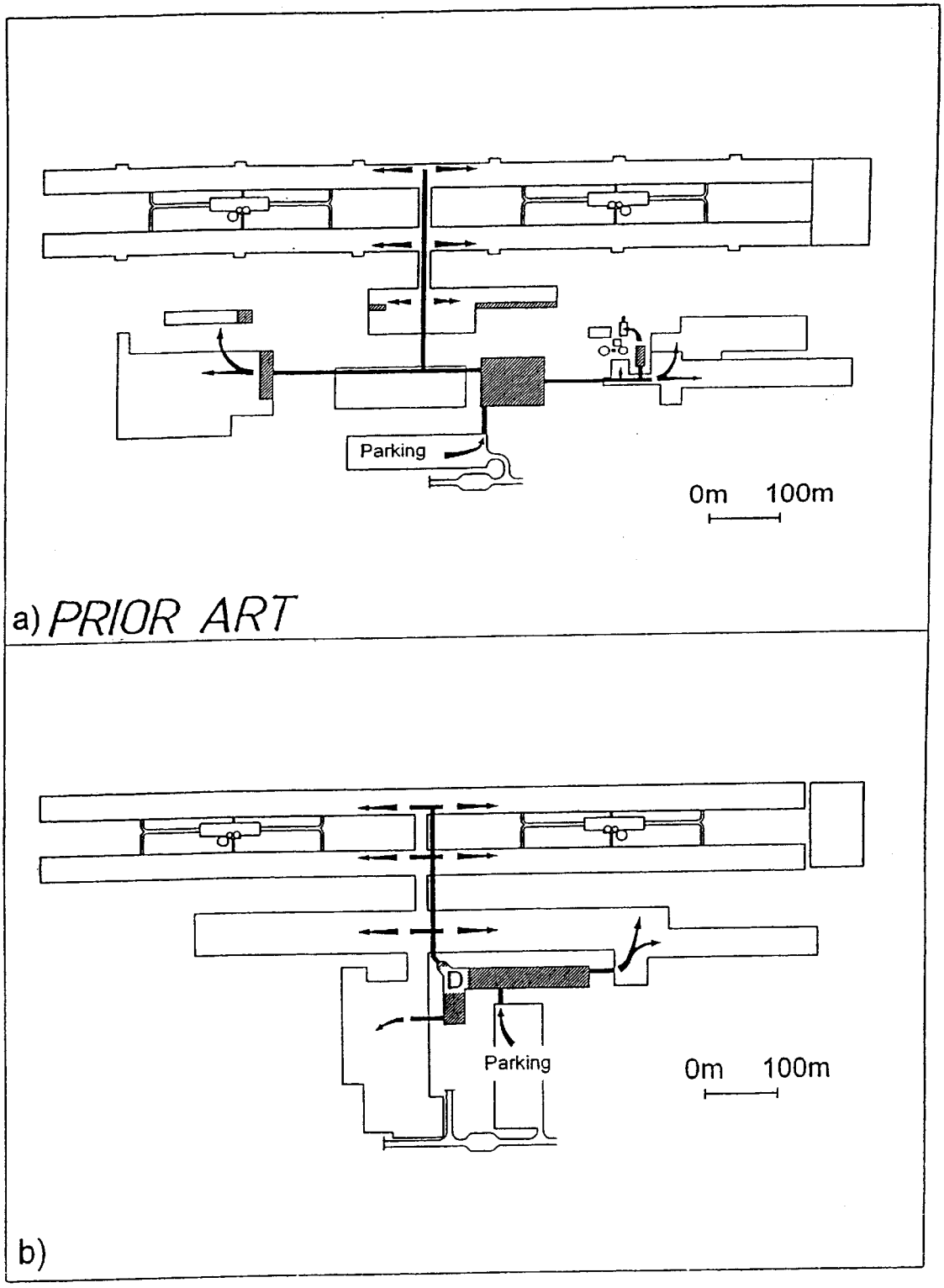

FIG. 1 illustrates an electrolysis plant arrangement of the prior art. FIG. 2 illustrates an electrolysis hall in cross section along the plane A—A of FIG. 1. FIG. 3 illustrates an electrolytic cell in cross section along the plane B—B of FIG. 2. FIG. 4 illustrates an electrolysis plant arrangement of the invention. FIG. 5 illustrates an embodiment of the reserved transit zones of the invention. FIGS. 6 to 10 illustrate the flows of anode assemblies (FIG. 6), of liquid and solid bath (FIG. 7), of liquid metal (FIG. 8), of raw materials and end products (FIG. 9) and of personnel (FIG. 10) in a plant of the prior art shown in FIG. 1 and FIGS. 6*a*, 7*a*, 8*a*, 9*a* and 10*a* and in a plant arrangement according the preferred embodiment of the invention shown in FIG. 4 and FIGS. 6*b*, 7*b*, 8*b*, 9*b* and 10*b*.

Such as shown in FIG. 1, the electrolysis plants of the prior art typically comprise a liquid aluminum production zone H, which comprises electrolysis pots normally arranged in series (not shown), supply and recycling installations for the anode assemblies 11, 12, 13, 14, 15, 16, installations for the supply and recycling of electrolytic bath 13, 14, 15, 17, installations for the processing of liquid aluminum 20, 21, 22 and installations intended for the maintenance of production equipment 31, 32, 33, 34, 35 and at least one administrative building 36. Firstly, the installations for the supply and recycling of anode assemblies, the installations for the supply and recycling of electrolytic bath and the installations for the processing of liquid aluminum are generally located in isolated zones of the plant; secondly, the installations intended for the maintenance of production equipment and the administrative buildings are distributed over the entire plant.

The liquid aluminum production zone H typically comprises an even number of electrolysis halls 1, generally two or four halls arranged in parallel, electric supply means to the electrolysis pots 2, alumina supply means 3, 4 and means 5 to treat the gases emitted by the process, transit routes 6 parallel to the electrolysis halls and access means 7 to the electrolysis halls. The electrolysis halls may comprise one (or more) transfer halls 8 to facilitate the movement of personnel and possibly the transport of certain equipment and tooling. Each electrolysis hall 1 comprises at least one line of electrolysis pots (not shown), the number of pots in one pot-line possibly being more than one hundred.

The installations for the supply of anode assemblies most often comprise means for the supply of raw materials 11, 16, installations intended for the production of anode blocks, the assembly of anode assemblies and the recycling of spent anodes 12, 13 and access means 14. The installations intended for the production of anode blocks 12 particularly comprise forming means for raw anodes and baking means for the latter (typically comprising a ring furnace). The installations for the recycling of the anode assemblies 15 comprise means for separating the anodes from the anode stems, and means for grinding the spent anode blocks for the purpose of their recycling in the production of new anode blocks.

The installations for the production of liquid aluminum 20, 21, 22 typically comprise a smelting furnace and access means 21. The installations for the maintenance of production equipment are generally located in separate buildings 31, 32, 33, 34, 35 distributed over the plant site. Transit routes crisscross the entire plant 6, 61, 62, 63.

Such as illustrated in FIG. 2, an electrolysis hall 1 typically comprises roofing 71, a series of pots 40, a passageway or aisle 10 alongside the pots and a travelling crane 70 to conduct operations on the pots. As shown in FIG. 3, a pot 40 typically comprises a metal shell 41 lined on the inside with refractory materials 42*a*, 42*b*, cathode assemblies in carbon material 43, anode assemblies 55, a carrier structure 53, means 51 for collecting the effluents discharged from the pot in operation and means 50 to supply the pot with alumina and/or $AlF_3$. The anode assemblies 55 typically comprise an anode block 47*a*, 47*b* and a stem 49*a*, 49*b*. Each stem 49*a*, 49*b* typically comprises a multipode 48*a*, 48*b* to fix the anode block 47*a*, 47*b*.

When in operation, the pot comprises a bed of liquid aluminum 44, a bed of liquid bath 45 and a top cover 46 containing solid bath and alumina. In order to avoid having to change all the anode assemblies at the same time, the program for anode assembly changes is generally designed so that each one has a different degree of wear (in FIG. 3, anode block 47*a* is less spent than anode block 47*b*). The electrolysis current circulates from the anode blocks towards the cathode parts. The cathode current is collected by conductor bars 52.

FIGS. 6*a*, 7*a* and 8*a* respectively show the flows of anode assemblies FC1, FC2, of solid bath FB1, FB2, FB3, FB4 and of liquid aluminum FA1, FA2 in a plant of the prior art.

The flows of solid bath comprise two components: flows of so-called "pre-processing" bath FB1, FB2 (in bold lines) which are derived in particular from bath excesses removed from the electrolysis pots, and flows of so-called "crushed" bath FB3, FB4 (in dotted lines) which correspond to re-processed bath. As shown in the Figures, these heavy flows generally travel by routes 6 which are also regularly used by personnel. In addition, these flows are complex and comprise mass movements between the inner and outer parts of the electrolysis halls 1 and by-pass routes FC2, FB2, FB3, FA2. In particular, these flows travel via routes inside 10 and outside 6 the buildings which house the pot-lines, and comprise numerous entry and exit movements via access routes 7.

According to the invention, the arrangement of an electrolysis plant for the production of aluminum using the Hall-Heroult process, said plant comprising at least one liquid aluminum production zone H containing electrolysis pots arranged in lines, installations for the supply and recycling of anode assemblies, installations for the supply and recycling of electrolytic bath, installations for the processing of liquid aluminum, is characterized in that it comprises:

specific operational support zones including a zone C grouping together the installations for the supply and recycling of anode assemblies, a zone B grouping together the installations for the supply and recycling of electrolytic bath, and a zone A grouping together the installations for the processing of liquid aluminum, transport means to convey heavy intermediate products between said operational zones according to determined intermediate flows HC1–HC7, HB1–HB12, HA1–HA7, said intermediate products containing in particular liquid aluminum, anode assemblies and solid electrolytic bath, at least one transit zone 101, 102, 103, 104, 105, 106, 110, 111, 112, 113 reserved for all or part of said transport means for heavy intermediate products.

In the remainder of this disclosure, the expression "reserved transit zones" shall also designate the case when there is only one reserved transit zone. The reference "100" shall denote in grouped manner the different reserved transit zones 101, 102, 103, 104, 105, 106, 110, 111, 112, 113.

Such as illustrated in FIGS. 6*b*, 7*b* and 8*b* all or part of the heavy flows transit via the reserved transit zones 100. As shown by the arrows, the flows of anode assemblies HC1, . . . , HC7 are generally of a bi-directional nature (FIG. 6*b*) in that new and spent anodes may travel on the same route but in opposite direction, whereas the flows of solid bath HB1, . . . , HB12 and liquid metal HA1, . . . HA7 are generally of a unidirectional nature (FIGS. 7*b* and 8*b*) in that the solid bath does not return to zone H by the same routes and in that the liquid metal does not generally return to the electrolysis pots.

According to the invention, at least one given heavy intermediate product is preferably entirely conveyed in at least one transit zone reserved for it. Preferably, the main heavy intermediate products, namely the liquid aluminum, the anode assemblies and the solid electrolytic bath, are entirely conveyed in at least one reserved transit zone. It is particularly advantageous that at least one reserved transit zone 101, 102, 110, 111, 112, 113 should be common to at least two separate heavy intermediate products.

The reserved transit zones 100 are preferably specifically equipped for the conveying of said heavy flows.

The arrangement of the invention may also comprise access routes 9 (FIG. 4) giving access to different installation parts for their maintenance.

According to one variant of the invention, at least one so-called "maintenance" operational support zone E may group together all or part of the maintenance and servicing operations, and preferably all such operations. According to another variant of the invention, at least one so-called "administration" operational support zone D may group together all or part of administrative operations, and preferably all such operations. The administration zone may comprise installations for flow management and/or quality control of the intermediate products. The arrangement of the invention advantageously comprises at least one maintenance operation zone E and at least one administration operation zone D.

The reserved transit zones 100 are preferably located on one same level. For example, they may be located on the level of the side aisles 10 of the electrolysis halls 1. They may optionally comprise several levels. For example, one part of said zones may be located at the level of the side aisles 10 and another part may be located at ground level 80 outside the electrolysis halls 1. They may optionally comprise superimposed levels. For example, they may comprise a level on the level of the side aisles 10 and a level 72 located below the latter, each level possibly being used for the transport of different flows.

At least one reserved transit zone 101, 102, 103 connects at least two said operational zones, preferably at least three operational zones, and possibly all of the latter which will provide for efficient movement of the heavy flows via the reserved routes between said operational zones.

In the preferred embodiment of the invention, at least one so-called "cross" reserved transit zone 101, 102 is substantially perpendicular to said electrolysis pot-lines, such as shown in FIG. 5. Preferably, at least one so-called "main" reserved transit zone 101, 102 passes substantially through the barycentre of the (or each) liquid aluminum production zone H.

Advantageously, the zone for the supply and recycling of anode assemblies C, the zone for the supply and recycling of electrolytic bath B, the liquid aluminum processing zone A, and optionally the maintenance zone E, are connected to the (or each) liquid aluminum production zone H by at least one cross and/or main reserved transit zone 101, 102, 103. Advantageously, there is only one cross and/or main traffic zone so as to limit investment cost and permits better flow control.

At least one so-called "side" reserved transit zone 110, 111, 112, 113 may optionally run alongside electrolysis pot-lines, advantageously inside the electrolysis halls 1. These side zones may possibly be located at the aisles 10 on other levels 72.

Preferably, the arrangement of the invention also comprises at least one building with specific roofing 121, 122 (FIG. 4) to shelter certain reserved transit zones such as certain cross zones 101, 102. The buildings with specific roofing allow certain problems to be avoided that are typically related to the formation of black ice, to rain, temperature or humidity.

The reserved transit zones 100 may comprise specific transport means dedicated to heavy flows between the operational zones, in particular between the electrolysis halls and the support zones A, B, C, D, E. These means advantageously comprise shuttles for the transport and delivery of specific parts such as:

tapping equipment (used to tap liquid metal from the electrolysis pots) and ladles of liquid metal (empty or full) between the pots and the liquid metal processing zone A or the maintenance zone E;

palettes of new anode assemblies between zone C and the pot-lines;

palettes of spent anodes between the pot-lines and zone C (which, in addition to recycling installations for the anode assemblies may also comprise bath recycling installations) or towards maintenance zone E;

bath containers (removed excess bath or crust to be recycled) which may be integrated into the palettes of anode assemblies;

platforms of pot maintenance equipment and tooling (for operations conducted during the stoppage or start-up of a pot series or a particular pot).

The transport means may possibly allow a reduction in intermediate storage areas, such as those normally provided for cooling the anodes or for the ladles of liquid metal. They may also allow for just-in-time handling operations especially in the variants of the invention providing for automated operations. The heavy flows of the invention may nonetheless comprise intermediate storage areas.

The transport means are advantageously associated with handling means. The transport means may comprise conveyors which have the advantage of being easily automated, or automotive equipment which may possibly be driven by operators.

Said transport means of intermediate products according to heavy flows may comprise a rail network. This track may advantageously be located outside the heavy structures of the electrolysis buildings, ensuring the connection between the or each production zone and the other operational zones in the plant. Mobile vehicles may travel on this network optionally in automated manner.

Also, automotive vehicles driven by operators may also travel on other specific routes outside the reserved zones 100 in one or more traffic lanes.

The electrolysis halls may also comprise additional transport or maintenance means. For example, each hall may comprise maintenance travelling cranes for the handling of pot shells (before and after relining) and/or superstructures, going to or coming from the maintenance workshops. The reserved transit zones 100 may occasionally be used for the transport of heavy equipment such as travelling cranes or pot shells, which are not part of regular heavy flows. These exceptional operations occur in particular during the stoppage or start-up of a pot or when the pot servicing machines are taken out of service for maintenance.

The plant of the invention may optionally include servicing machines which travel along the traffic lanes adjoining the structure of the buildings.

Such as illustrated in FIG. 6*b,* the flows of anode assemblies may comprise several branches HC1 to HC7. Some branches HC1 to HC4 run alongside the electrolysis pots and preferably inside the halls 1. Common branches HC5, HC6, HC7 may collect flows coming from several branches. Preferably, the flows of anode assemblies comprise one branch HC7 that is inside the supply and recycling zone for the anode assemblies C. In the case shown in FIG. 6*b,* the flows of new anode assemblies (towards the electrolysis pots) and flows of spent anodes (coming from the electrolysis pots) follow paths that are substantially identical (but in opposite direction) except inside zone C. Preferably, zone C also comprises means for assembling the anode assemblies using baked anode blocks and recycled or new anode stems, and/or means for separating the anode blocks (spent or faulty) from the stems.

Zone C may comprise the entire production means for anode blocks, such as a paste workshop, forming means for the crude anode blocks and a ring furnace. This grouping gives a compact lay-out of installations concentrating together those operations which produce carbon dust, and handling and process equipment.

It may also be advantageous to produce anode blocks in a separate plant, outside the site, in which case zone C may only comprise means such as handling means and anode block storage means.

It is also particularly advantageous to group together zones C and B. By so doing it is possible to make more efficient collection of the solidified bath crusts on the spent anode assemblies removed from the electrolysis pots. In addition, with this grouping together it is possible to transport both the spent assemblies and the solid bath crusts removed from the pots.

Such as illustrated in FIG. 7*b,* the flows of solid bath may also comprise several branches HB1 to HB12. The flows comprise branches HB1 to HB7 for "preprocessing" bath and branches HB8 to HB12 for the "crushed" bath, that is to say after processing. Some branches HB1 to HB4 run alongside the electrolysis pot lines preferably inside the halls 1. Common branches HB5, HB6, HB7 may collect the flows from several branches. Preferably, the flows of electrolytic bath comprise a branch HB7 inside the zone for the supply and recycling of electrolytic bath, which is only shown here in simplified form.

Such as illustrated in FIG. 8*b,* the flows of liquid metal may also comprise several branches HA1 to HA7. Some branches HA1 to HA4 run alongside the electrolysis potlines and preferably inside the halls 1. Common branches HA5, HA6, HA7 may collect the flows from several branches. Preferably, the flows of liquid metal comprise a branch HA7 inside the zone for the processing of liquid aluminum, which is only shown here in simplified form.

The liquid aluminum processing zone A may comprise smelting means in which the liquid metal may be finished, treated and formed. According to one variant of the invention in which the smelting means are located in a separate plant, outside the site, the processing zone A may only comprise a reduced number of means, such as handling and loading means for the liquid metal and optionally cooling means.

Such as shown in FIG. 9*b,* the electrolysis plant of the invention also comprises:

means for transporting and conveying raw materials, such as alumina, from entry points E1, E2 of the plant to the corresponding operational zones, according to determined incoming flows, such as a flow of alumina FA0 and a flow of carbon FC0;

means for transporting and conveying end products, such as aluminum smelting products, from the operational zones towards exit points S1, according to determined outgoing flows FM.

Such as shown in FIG. 10*b,* the flows of personnel (shown by arrows) do not pass through the reserved transit zones 100. Personnel may, however, move along routes parallel to these zones and optionally enter into reserved zones for maintenance or repair operations. The shaded sections relate to spaces typically reserved for office use. The plant of the invention preferably comprises routes 6, 61, 62, 63 for movement of personnel which do not cut across reserved zones 100. Personnel move and work within the electrolysis halls without taking the reserved routes located in the reserved transit zones. Intersection points between reserved zones and routes for personnel may be avoided by passageways located at different levels such as underpasses, bridges, stairs, escalators or lifts.

Special transport means may be provided in parallel or superimposed zones, which do not intersect reserved transit zones. For example, transporter bridges may be provided above certain reserved zones in order to transport certain servicing machines or pot shells between the production zones H and the maintenance zone E.

With the invention it is possible to considerably limit the number of access routes 7 to the electrolysis halls.

The invention also provides for more efficient distribution of transport between operational zones (or sectors). In particular, it brings closer working relations between buildings and the development of synergies between the operational zones. It also avoids the recourse to substantial intermediate stocks of raw materials or processed products. It also reduces the risks of transport-related accidents.

Through the invention, personnel can be relieved of some repetitive, non-complex handling operations. It can also limit the diversity and number of operations assigned to operators and service machines, bringing an improvement in the quality and regularity of pot servicing work and hence in the operational performance of the industrial process as a whole.

With the invention, it is also possible to avoid the use of sophisticated machinery, normally intended for pot servicing, to effect transport operations of heavy loads over single journeys, which are sometimes long and at frequent intervals. It also avoids the concentration of heavy flow handling inside the electrolysis halls, thereby reducing construction costs and limiting ill-functioning of which a large part is due to the cumulative effects of various equipment failures or human error.

Through the invention, it is also possible to automate simple, repetitive jobs which, in the plants of the prior art, are carried out by machines which are also used for complicated tasks that are difficult to automate.

The invention also brings a significant reduction in access structures, and related stairways, footbridges, systems and installations, such as lighting systems, fire protection, air conditioning/heating and/or communication systems.

French Patent Application No. 0003813 filed on Mar. 24, 2000, is incorporated by reference.

What is claimed is:

1. An arrangement of an electrolysis plant for production of aluminum comprising:

a. operational zones including at least one liquid aluminum production zone containing electrolysis pots arranged in lines, installations for the supply and recycling of anode assemblies, installations for the supply and recycling of electrolytic baths, and installations for the processing of liquid aluminum, b. operational support zones comprising:

(i) a first zone grouping together the installations for the supply and recycling of anode assemblies, (ii) a second zone grouping together the installations for the supply and recycling of electrolytic baths, and (iii) a third zone grouping together the liquid aluminum processing installations, c. transport means to convey heavy intermediate products between said operational zones, according to determined intermediate flows, said intermediate products including liquid aluminum, anode assemblies and solid electrolytic baths, and d. at least one transit zone located between said liquid aluminum production zone and at least one of said operational support zones, said transit zone being reserved for at least part of said transport means for the heavy intermediate products.

2. Arrangement according to claim 1, wherein at least one of the heavy intermediate products is entirely conveyed in the at least one reserved transit zone.

3. Arrangement according to claim 1, wherein the liquid aluminum, the anode assemblies and the solid electrolytic baths are entirely conveyed in the at least one reserved transit zone.

4. Arrangement according to claim 1 or 3, wherein the at least one reserved transit zone is common to at least two separate heavy intermediate products.

5. Arrangement according to any of claims 1 to 3, further comprising at least one maintenance operational support zone which groups together at least part of maintenance and servicing operations of the process.

6. Arrangement according to any of claims 1 to 3, further comprising at least one administration operational support zone which groups together at least part of administrative operations of the process.

7. Arrangement according to any of claims 1 to 3, wherein the supply and recycling zone for the anode assemblies also comprises means for the production of anode blocks.

8. Arrangement according to any of claims 1 to 3, wherein the first zone and the second zone are grouped together.

9. Arrangement according to any of claims 1 to 3, wherein the at least one reserved transit zone connects at least three of said operational zones.

10. Arrangement according to any of claims 1 to 3, wherein the at least one reserved transit zone connects together all said operational zones.

11. Arrangement according to any of claims 1 to 3, wherein at least one cross reserved transit zone is substantially perpendicular to the said electrolysis pot-lines.

12. Arrangement according to claim 11, wherein each support zone is connected to the at least one liquid aluminum production zone by at least one cross reserved transit zone.

13. Arrangement according to any of claims 1 to 3, wherein at least one main reserved transit zone passes substantially through the barycentre of the at least one liquid aluminum production zone.

14. Arrangement according to claim 13, wherein each support zone is connected to the at least one liquid aluminum production zone by at least one main reserved transit zone.

15. Arrangement according to any of claims 1 to 3, further comprising at least one building with specific roofing to shelter at least one reserved transit zone.

16. Arrangement according to any of claims 1 to 3, wherein the at least one reserved transit zone runs alongside said electrolysis pot-lines.

17. Arrangement according to any of claims 1 to 3, wherein said transport mean are automated.

18. Arrangement according to any of claims 1 to 3, wherein said transport means comprise at least one shuttle.

19. Arrangement according to any of claims 1 to 3, wherein said transport means comprise handling means.

20. Arrangement according to any of claims 1 to 3, wherein said transport means comprise a rail network.

21. Arrangement according to any of claims 1 to 3, wherein said transport means comprise at least one conveyor.

22. An arrangement according to claim 1, wherein said flow of anode assemblies is bi-directional, and wherein said flows of said solid electrolytic baths and said liquid aluminum are in a single direction.

* * * * *